US006334587B1

(12) United States Patent
Röder

(10) Patent No.: US 6,334,587 B1
(45) Date of Patent: Jan. 1, 2002

(54) SPARE PAPER ROLL

(75) Inventor: Klaus Walter Röder, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/319,943

(22) PCT Filed: Dec. 19, 1997

(86) PCT No.: PCT/DE97/02983

§ 371 Date: Aug. 30, 1999

§ 102(e) Date: Aug. 30, 1999

(87) PCT Pub. No.: WO98/28213

PCT Pub. Date: Jul. 2, 1998

(30) Foreign Application Priority Data

Dec. 21, 1996 (DE) ..... 196 53 814

(51) Int. Cl.[7] ..... B65H 26/00

(52) U.S. Cl. ..... 242/563; 242/534; 242/912; 242/160.4

(58) Field of Search ..... 242/563, 563.2, 242/534, 534.2, 912, 160.1, 160.4

(56) References Cited

U.S. PATENT DOCUMENTS

| | | | | |
|---|---|---|---|---|
| 4,620,184 A | * | 10/1986 | Nedstedt | 242/912 X |
| 5,033,623 A | | 7/1991 | Grecksch et al. | |
| 5,691,919 A | * | 11/1997 | Gemmell et al. | 242/563 X |
| 5,769,353 A | * | 6/1998 | Juhe et al. | 242/563 |

FOREIGN PATENT DOCUMENTS

| | | | | |
|---|---|---|---|---|
| DE | G8513812.6 | | 6/1985 | |
| DE | 3816800 A1 | | 11/1989 | |
| DE | 4005548 | * | 8/1991 | 242/563 |
| DE | G 9115827.3 | | 2/1992 | |
| DE | 4421485 A1 | | 12/1995 | |
| EP | 459668 | * | 12/1991 | 242/912 |
| EP | 0597184 A1 | | 7/1993 | |

* cited by examiner

*Primary Examiner*—William A. Rivera
(74) *Attorney, Agent, or Firm*—Jones, Tullar & Cooper, PC

(57) ABSTRACT

An active code carrier is located inside a spare paper roll that includes a tube or core. The code carrier interacts with either a reading head, or a writing head. This enables roll-specific data to be read or updated at any time. This is particularly useful for automated roll transport and roll handling systems.

3 Claims, 3 Drawing Sheets

SPARE PAPER ROLL

FIELD OF THE INVENTION

The invention relates to a spare paper roll such as a paper web roll. The roll is wound on a winding core or tube. A core carrier, that has a data memory is provided in the spare web roll or in the tube.

DESCRIPTION OF THE PRIOR ART

It is generally known to provide spare paper web rolls with a 16-digit bar code identification on their outer packaging, for example in accordance with a recommendation of the IFRA Newsprint Committee, for example. This numerical code includes, for example, number of the the roll, the weight of the roll, the type of packaging, the basis weight, the quality, as well as the manufacturer's code. As a rule, this bar code identification is scanned by means of a laser scanner.

In connection with this coding, the lack of legibility because of damage to the code support is disadvantageous, for example. This can result in the loss of information or to incorrect information.

DE 91 15 827 U1, EP 0 597 184 A1, DE 38 16 800 A1, DE 85 13 8. U1 and DE 44 21 485 A1 disclose roll supports, in whose vicinity a code carrier is arranged. A bar code is applied to these code supports.

It is disadvantageous in this connection that it is not possible to record on these code carriers again, or respectively to record additional data on them.

WO 94/28531 shows a spare web roll with an information carrier. The spare web roll has a winding core or a tube.

DE 39 12 488 A1 describes a method for transmitting product information regarding a textile bobbin by means of an electronic memory chip which can be read and erased.

SUMMARY OF THE INVENTION

WO 98/28213 shows a spare web roll with a tube. An active code carrier is arranged in the tube.

DE 39 12 488 A1 describes a method for transmitting product information regarding a textile bobbin by providing either the winding core or the tube for the spare web roll, or the spare web roll itself with a core carrier which can be activated and which has a data memory. memory chip which can be read and erased.

The object of the invention is based on providing a spare web roll with an information carrier.

The advantages which can be achieved by means of the present invention reside, in particular, in that the code carrier is arranged independently of the outer packaging, or respectively the outer layer of the web, so that the code carrier can be interrogated at any time. It is furthermore possible to provide the code carrier with new, or respectively supplemental data, and to store these. Such data could be, for example, information regarding a new destination, length of the remaining paper, particulars of the quality—for example, a "beating" roll—and the like.

BRIEF DESCRIPTION OF THE DRAWINGS

Preferred embodiments of the present invention are represented in the drawings and will be described in greater detail in what follows. Shown in the drawings are in.

DESCRIPTION OF THE PREFERRED EMBODIMENTS

Figure 2:
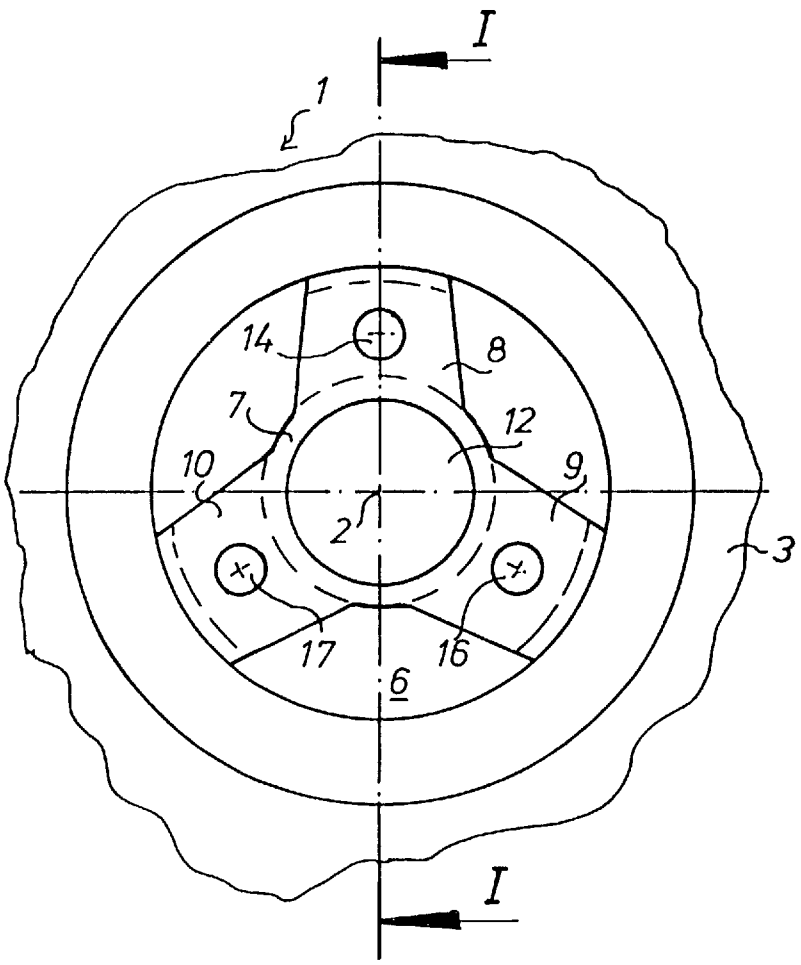
FIG. 2, a plan view A in accordance with FIG. 1.
Figure 1:
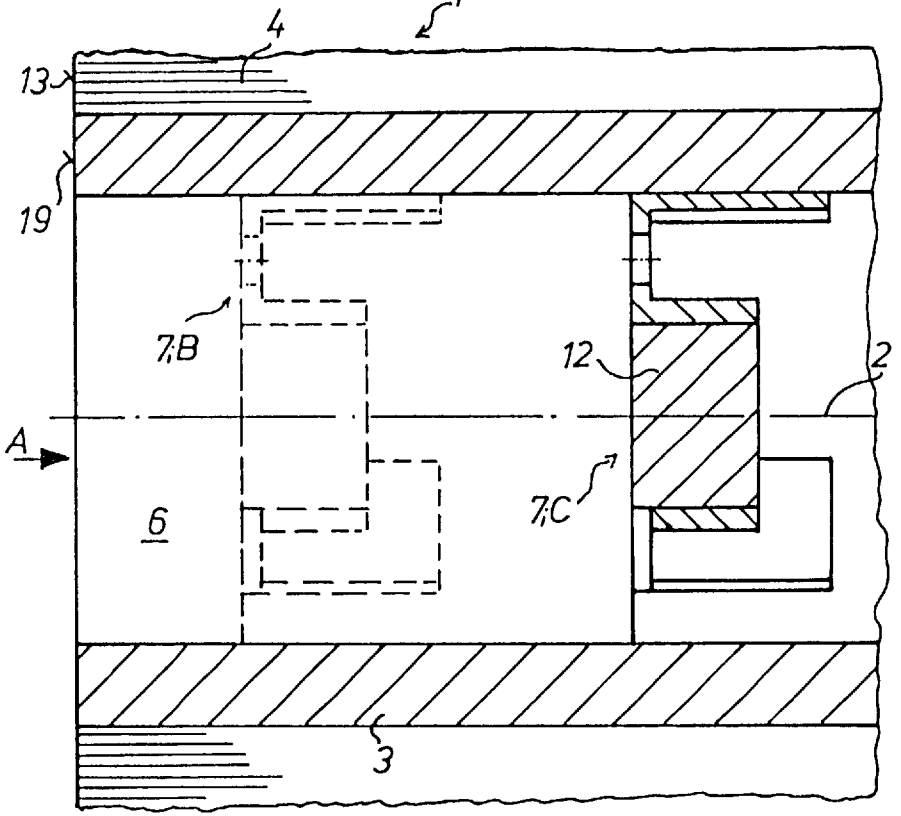
FIG. 1, a longitudinal section I—I in accordance with FIG. 2 through a portion of a spare paper web roll with a code carrier arranged in the end area of the tube.

A spare web roll, for example a spare paper web roll 1 for a web-fed rotary printing press, has a continuous tube 3 in the area of its axis of rotation 2, on whose tube body a web 4 of material has been wound, all as seen in FIGS. 1 and 2. A star-shaped, for example three-armed holder 7 is arranged in the end area of the tube, and in particular in the area of the interior diameter, or respectively interior 6 of the tube 3, whose arms 8, 9, 10 rest resiliently against the interior circumference 6. For example, the holder 7 supports a cylinder-shaped or disk-shaped code carrier 12, which can be activated, i.e. can be coded and decoded, coaxially with the axis of rotation 2. The code carrier 12 is an electronic component, which can be coded by inductive means.

The holder 7 can be inserted, for example into the end area of the tube 3 of a spare paper web 1 roll, i.e. into the interior 6 of the tube 3, in such a way that it remains in a temporary first position B, i.e. close to the lateral edges 13 of the web of material 4 as—represented in dashed lines in FIG 1. Only when the spare paper web 1 roll is placed on the shaft, is the holder 7 pushed into a second position C by means of a clamping cone, not represented. The holder 7 will now be in the position shown in solid lines in FIG. 1.

After the roll is used up, for example, the holder 7 can again be taken out of the tube 3 by removing it. For this purpose the arms 8, 9, 10 can have bores 14, 16, 17, for example, behind which a suitable tool can reach.

Figure 3:
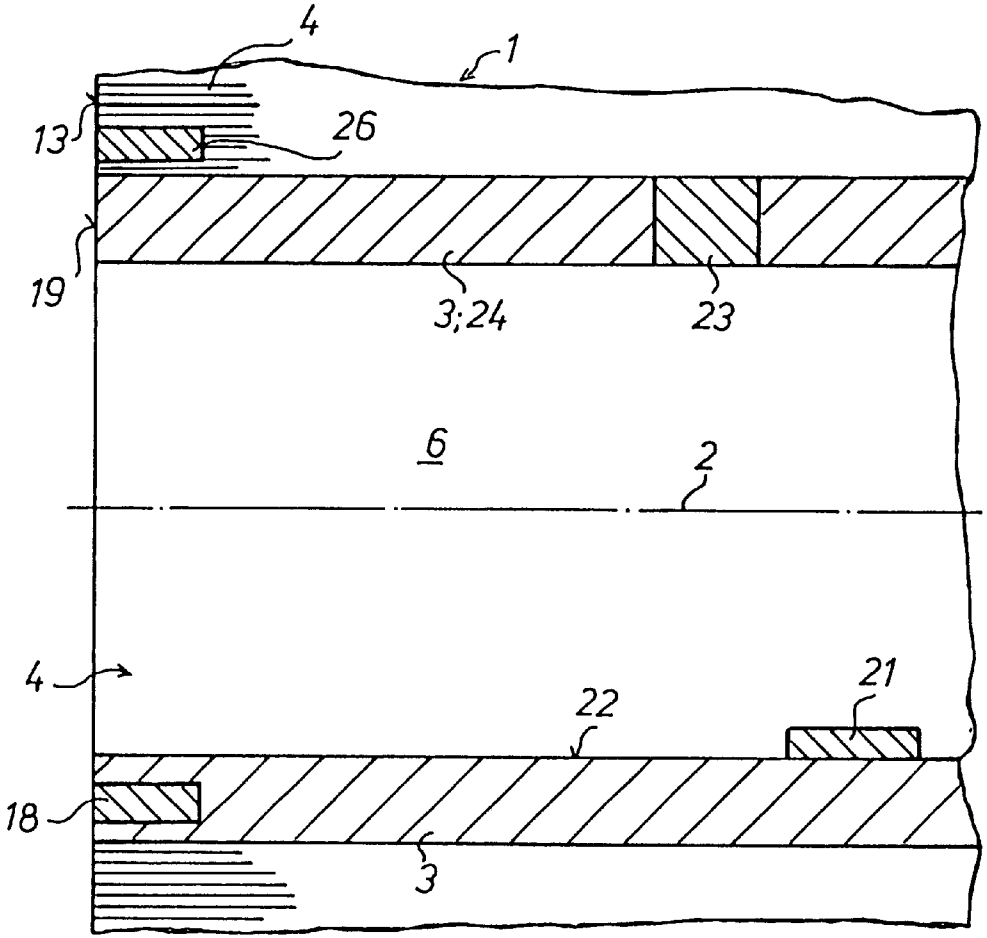
FIG. 3, a longitudinal section through an end of a tube with several code carriers, which are alternatively arranged on the tube end; and in FIG. 4, a data flow chart for the flow of information between a code carrier and read/record and evaluation units.

A number of code carriers 18, 21, 23, 26 are represented in respectively different fastening positions in FIG. 3. However, only one of which is used.

A code carrier 18 is arranged in the front face 19 of the tube 3, i.e. in the tube body, and may for example be pressed into a bore.

A code carrier 21 is fastened to the inner surface 22 of the tube 3, i.e. in the interior 6 of the tube 3, for example by gluing.

A code carrier 23 is arranged in the tube body 3. In this case, the tube wall 24 can have a bore into which the code carrier 23 is pressed.

It is also possible to arrange a code carrier 26 in the webs of material 4 which are close to the tube 3, i.e. the inner or lower ones, i.e. to introduce it from the direction of the lateral edges 13 of the webs of material 4 into an area close to the edge, for example to press it in. Therefore the code carrier 26 is outside of and in the vicinity of the tube 3.

Figure 4:
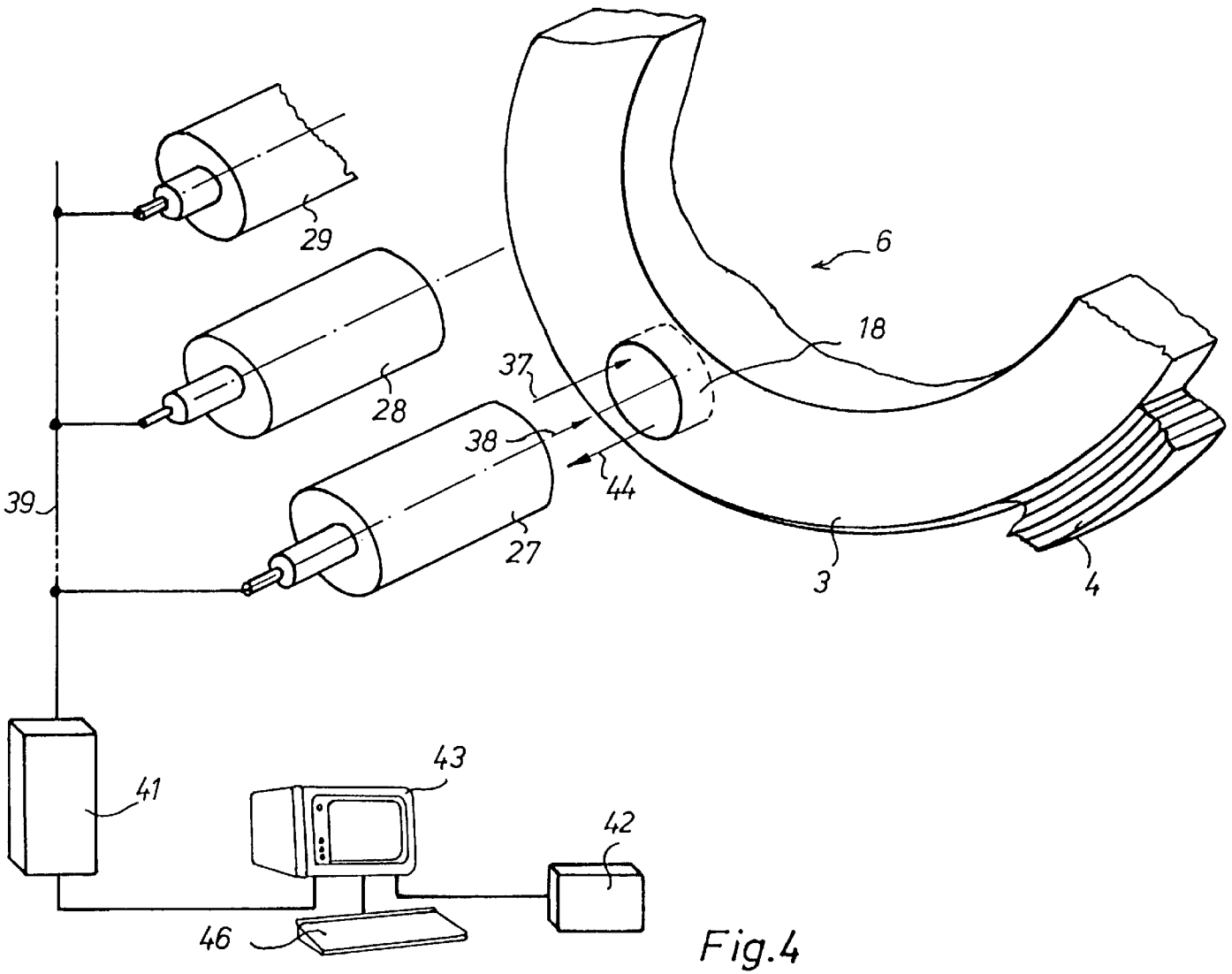

The code carriers 12, 18, 21, 23, 26 arranged in the interior of the tube 3 or in the vicinity of the tube 3, for example the code carrier 18 located in the front face 19 of the tube 3, are connected with one of the recording and reading heads 27, 28, 29. Such recording and reading heads 27, 28, 29 are, as shown in FIG. 4, stationed along a conveyance path for movable spare paper web transport carriages, for example the recording and reading head 27 in the vicinity of a storage facility for spare paper web rolls 1, the recording and reading head 28 is locked in the vicinity of a preparation station for spare paper web, and the recording and reading head 29 is located in the vicinity of a roll changer.

Each recording and reading head 27 to 29 consists of an electronic component, which transmits energy 37 and information 38 in a contactless manner to the code carrier 18. On the other end, all recording and reading heads 27 to 29 are connected with each other via a data bus 39, as well as with an evaluation unit 41 and a control device 42, as well as a master computer 43, all as shown in FIG 4. The master computer 43 has an input station 46.

The code carrier 18, as well as the other code carriers 12, 21, 23, 26, are essentially embodied as data memory devices, and respectively consist of an electronic component with a memory and logical control device. The above mentioned code carriers are, for example, designed as EEPROM versions, and can be written on and read out, for example, with up to eight Kilobytes.

If, for example, a spare paper web roll 1 is moved out of the storage facility—the transport carriages are, for example, pulled by means of under-floor or driverless transport systems—the code carrier 18 located in the tube 3 of the spare paper web roll 1 passes by the recording/reading head 27. As soon as the code carrier 18 comes into the active area of the recording/reading head 27, the energy 37 required for data transmission is built up and the data 38 are transmitted by the recording/reading head 27 to the code carrier 18, and the data 44 are transmitted by the code carrier 18 to the recording/reading head 27, each in a frequency range of, for example, 70 Kilohertz. Such data can be, besides the data entered by the manufacturer: new destination, for example the spare paper web preparation station, remaining length of paper, particularities of the paper, for example a "beating" roll.

The data, which are inductively coupled in by the code carrier 18, are converted into a digital energy signal and conducted to the evaluation unit 41. The evaluation unit 41 manages the data transfer 37, 44 between the recording/reading head 28 and the code carrier 18 and is used as an intermediate memory. The evaluation unit 41 is the connecting member between the master computer 43, or respectively the control device 42, and the code carrier 18. Data can be erased or new data can be added, such as for example, a new destination, the gluing preparation station and the type of the glue tip. Following the gluing preparation of the spare paper web roll 1, it is possible to enter a further destination, for example a roll changer, by means of the recording/reading head 28. After a portion of the spare paper web roll 1 has been used, another entry to the roll data takes place by means of the recording/reading head 29, as well as a new destination, for example a storage facility.

It is also possible to arrange only stationary reading devices for the purpose of reading out the destination at appropriate positions on the transport path, for example at switches.

In accordance with a further preferred embodiment, the recording/reading head 29 can be arranged in the roll changer, i.e. for example in a roll cone of a support arm of the roll changer, so that a data exchange can take place between the recording/reading head 29 and a code carrier 18 while the spare paper web roll 1 is still on the shaft. Alternatively it is also possible to fasten the recording/reading head 29 on the end of the support arm of the roll changer.

The data exchange preferably takes place during the run-out of the spare paper web roll 1, i.e. while the spare paper web roll 1 turns slowly.

It is also possible to utilize a code carrier 12 arranged in the area of the imagined axis of rotation 2 of the spare paper web roll 1 in the interior 6 of the tube 3. In this case the recording/reading head 12 is arranged in the direction of an extended axis of rotation 2 on the exterior of a support arm of the roll changer. Here, the clamping cone is designed to be hollow.

While preferred embodiments of a spare paper roll in accordance with the present invention have been set forth fully and completely hereinabove, it will be apparent to one of skill in the art that a number of changes in, for example, the material used to construct the tube, the type of press with which the spare paper roll will be used, and the like may be made without departing from the true spirit and scope of the present invention which is accordingly to be limited only by the following claims.

What is claimed is:

1. A spare web roll comprising:

a winding tube, said winding tube having a hollow tube interior and a tube body defined by an inner tube body surface and an outer tube body surface;

a material web wound on said winding tube and in contact with said outer tube body surface; and a code carrier having a data memory, said code carrier being associated with said spare web roll outside of said hollow tube interior in said material web adjacent said outer tube body surface, said code carrier being activated with data outside of said hollow tube interior.

2. The spare web roll of claim 1 wherein said code carrier can be inductively coded and read.

3. A spare web roll comprising:

a winding tube, said winding tube having a hollow tube interior and a tube body defined by an inner tube body surface and an outer tube body surface;

a material web wound on said winding tube and in contact with said outer tube body surface; and a code carrier having a date memory, said code carrier being associated with said spare web roll outside of said hollow tube interior, said code carrier being activated with data outside of said hollow tube interior after partial consumption of said material web wound on said winding tube.

* * * * *